US009004284B2

(12) United States Patent
Bland et al.

(10) Patent No.: US 9,004,284 B2
(45) Date of Patent: Apr. 14, 2015

(54) MINERAL SLURRY DRYING METHOD AND SYSTEM

(71) Applicant: Nano Drying Technologies, LLC, Midlothian, VA (US)

(72) Inventors: Richard W. Bland, Beckley, WV (US); Bruce McDaniel, Midlothian, VA (US)

(73) Assignee: Vitrinite Services, LLC, Midlothian, VA (US)

( * ) Notice: Subject to any disclaimer, the term of this patent is extended or adjusted under 35 U.S.C. 154(b) by 33 days.

(21) Appl. No.: 13/841,191

(22) Filed: Mar. 15, 2013

(65) Prior Publication Data

US 2014/0144812 A1 May 29, 2014

Related U.S. Application Data

(63) Continuation-in-part of application No. PCT/US2011/041765, filed on Jun. 24, 2011, which is a continuation-in-part of application No. 12/924,570, filed on Sep. 30, 2010, now abandoned.

(60) Provisional application No. 61/247,688, filed on Oct. 1, 2009.

(51) Int. Cl.
*B03D 3/00* (2006.01)
*F26B 5/16* (2006.01)
(Continued)

(52) U.S. Cl.
CPC . *F26B 5/16* (2013.01); *B07B 13/14* (2013.01); *C10B 57/10* (2013.01); *F23K 1/00* (2013.01); *F23K 2201/20* (2013.01);
(Continued)

(58) Field of Classification Search
USPC ..... 209/3, 552; 34/333
See application file for complete search history.

(56) References Cited

U.S. PATENT DOCUMENTS 1,428,633 A 9/1922 Hoffman
2,411,288 A 11/1946 Morse
(Continued)

FOREIGN PATENT DOCUMENTS

CN 101229508 1/2011
DE 101 36 728 2/2003
(Continued)

OTHER PUBLICATIONS

Flanigen, Edith, M., Molecular Sieve Zeolite Technology—The First Twenty-Five Years, Pure and Applied Chemistry vol. 52, pp. 2191 (1980).
(Continued)

*Primary Examiner* — Terrell Matthews
(74) *Attorney, Agent, or Firm* — Hunton & Williams LLP

(57) ABSTRACT

The present invention provides methods and systems for reducing moisture in mineral slurries, particularly mineral slurries containing minerals of small particle diameter, using a granular drying material. The invention also relates to novel mineral products and intermediates useful in connection with the process. The method and system reduced moisture by contacting the mineral slurry with the granular drying material. The granular drying material is selected to be readily separated from the dried minerals using a size separation technique such as a sieve screen. The granular drying material is the regenerated, preferably using a process involving heat exchange and cross-flow air. The granular drying material is preferably capable of regeneration and recycling in a continuous process with minimal attrition.

22 Claims, 11 Drawing Sheets

(51) Int. Cl.

| | |
|---|---|
| ***B07B 13/14*** | (2006.01) |
| ***C10B 57/10*** | (2006.01) |
| ***F23K 1/00*** | (2006.01) |
| ***F26B 25/04*** | (2006.01) |
| ***F26B 25/22*** | (2006.01) |

(52) U.S. Cl.

CPC ..... *F23K 2201/30* (2013.01); *F23K 2201/505* (2013.01); *F26B 25/04* (2013.01); *F26B 25/22* (2013.01)

(56) References Cited

U.S. PATENT DOCUMENTS

| | | | | |
|---|---|---|---|---|
| 2,486,778 | A | | 11/1949 | Doumani |
| 2,656,118 | A | | 10/1953 | Chelminski |
| 2,713,026 | A | | 7/1955 | Kelly et al. |
| 2,786,816 | A | | 3/1957 | Guerin |
| 2,853,797 | A | | 9/1958 | Graham et al. |
| 2,876,863 | A | | 3/1959 | Kivari |
| 2,970,689 | A | | 2/1961 | Chang et al. |
| 3,043,426 | A | | 7/1962 | Noone |
| 3,193,491 | A | | 7/1965 | Cramer et al. |
| 3,212,641 | A | | 10/1965 | Komarmy et al. |
| 3,219,194 | A | | 11/1965 | Schwartzwalder et al. |
| 3,234,125 | A | | 2/1966 | Bloch |
| 3,283,908 | A | | 11/1966 | Komarmy et al. |
| 3,327,402 | A | | 6/1967 | Lamb et al. |
| 3,623,223 | A | | 11/1971 | Severinghaus |
| 3,654,705 | A | | 4/1972 | Smith et al. |
| 4,014,106 | A | | 3/1977 | Bearce |
| 4,191,530 | A | | 3/1980 | Bearce |
| 4,219,519 | A | | 8/1980 | Goksel |
| 4,244,813 | A | | 1/1981 | Moyer, Jr. |
| 4,284,413 | A | | 8/1981 | Capes et al. |
| 4,438,161 | A | | 3/1984 | Pollock |
| 4,487,577 | A | | 12/1984 | Watson |
| 4,504,274 | A | | 3/1985 | Anderson |
| 4,690,076 | A | | 9/1987 | Peletz, Jr. et al. |
| 4,799,799 | A | | 1/1989 | Sapko et al. |
| 4,892,567 | A | | 1/1990 | Yan |
| 4,938,864 | A | | 7/1990 | Frazier et al. |
| 5,087,269 | A | | 2/1992 | Cha et al. |
| 5,137,747 | A | | 8/1992 | Malandain et al. |
| 5,199,185 | A | | 4/1993 | Davidson |
| 5,298,179 | A | | 3/1994 | Ukita et al. |
| 5,384,343 | A | | 1/1995 | Farrar et al. |
| 5,403,365 | A | | 4/1995 | Merriam et al. |
| 5,486,998 | A | | 1/1996 | Corso |
| 5,577,333 | A | | 11/1996 | Shick et al. |
| 5,637,547 | A | * | 6/1997 | Chopin et al. ..... 502/415 |
| 5,815,946 | A | | 10/1998 | Dean |
| 6,328,099 | B1 | | 12/2001 | Hilt et al. |
| 6,572,040 | B1 | | 6/2003 | Brown, Jr. |
| 6,986,213 | B2 | | 1/2006 | Kruithof |
| 7,682,702 | B2 | * | 3/2010 | Nitschke ..... 428/503 |
| 7,695,535 | B2 | | 4/2010 | Dunlop |
| 8,302,325 | B2 | * | 11/2012 | Harsh et al. ..... 34/354 |
| 8,349,188 | B2 | * | 1/2013 | Soane et al. ..... 210/666 |
| 2002/0112957 | A1 | | 8/2002 | Clyde et al. |
| 2002/0136673 | A1 | | 9/2002 | Lebas et al. |
| 2004/0040173 | A1 | | 3/2004 | Kruithof et al. |
| 2005/0009956 | A1 | | 1/2005 | Kimura |
| 2007/0151147 | A1 | | 7/2007 | Learey et al. |
| 2009/0026145 | A1 | | 1/2009 | Hovland et al. |
| 2009/0071067 | A1 | | 3/2009 | MacPherson et al. |
| 2009/0165361 | A1 | | 7/2009 | Rappas et al. |
| 2010/0176226 | A1 | | 7/2010 | Avant et al. |
| 2011/0078917 | A1 | | 4/2011 | Bland et al. |
| 2011/0179695 | A1 | | 7/2011 | Harsh et al. |
| 2011/0247233 | A1 | | 10/2011 | Bland et al. |
| 2011/0252662 | A1 | | 10/2011 | Bland et al. |

FOREIGN PATENT DOCUMENTS

| | | | |
|---|---|---|---|
| EP | 326382 | | 8/1989 |
| EP | 0464788 | | 1/1992 |
| EP | 0837143 | | 4/1998 |
| GB | 2107732 | | 5/1983 |
| GB | 2229171 | | 9/1990 |
| JP | 05294692 | | 11/1993 |
| JP | 09100470 | | 4/1997 |
| JP | 2006035176 | | 2/2006 |
| WO | WO 2007129322 | A2 * | 11/2007 |
| WO | WO 2010019246 | | 2/2010 |
| WO | WO 2011040965 | | 4/2011 |
| WO | WO 2012047336 | A2 * | 4/2012 |

OTHER PUBLICATIONS

Jameson cell for Retreating Coal Tailings, Queensland Mining and Energy Bulletin, Summer, 2010/11.

International Preliminary Report on Patentability of PCT/US2010/056045, mailed May 23, 2013.

Notification of Intellectual Property Option Agreement dated Nov. 2, 2012.

International Search Report issued in corresponding International Application No. PCT/US2014/027168, mailed Jul. 23, 2014.

Written Opinion of the International Search Authority issued in corresponding International Application No. PCT/US2014/027168, mailed Jul. 23, 2014.

Supplementary European Search Report issued in corresponding European Application No. EP10820944.6, dated Aug. 19, 2014.

Chinese Office Action issued in corresponding Chinese Application No. 201080054474.4, dated Jun. 5, 2014.

* cited by examiner

MINERAL SLURRY DRYING METHOD AND SYSTEM

RELATED APPLICATIONS

The present application is a continuation-in-part of Patent Cooperation Treaty (PCT) Application Serial No. PCT/US2011/041765 entitled "MINERAL SLURRY DRYING METHOD AND SYSTEM" filed Jun. 24, 2011; this application claims priority as a continuation in part of patent application Ser. No. 12/924,570 entitled "COAL FINE DRYING METHOD AND SYSTEM" filed Sep. 30, 2010 which claims benefit from U.S. Provisional Patent Application Ser. No. 61/247,688 filed Oct. 1, 2009. The contents of these applications are incorporated by reference in their entirety.

FIELD OF INVENTION

The present invention relates generally to removing moisture from mineral slurries and in particular slurries of metal containing minerals such as iron ore.

BACKGROUND OF THE INVENTION

In the continued push for cleaner technology, a concurrent growth trend is the better mining and utilization of mineral resources. As used herein, mining of mineral resources includes not only the extraction from the ground, but also the processing of the resource to extract in its raw or otherwise usable form. The mining of mineral resources follows a complicated process that includes the generation of slurries concentrates having mineral slurries having high moisture content. The slurry contains the important minerals, but needs to be properly separated from the moisture content.

Concentrated mineral slurries have been the subject of dewatering processes for many years. The production includes mineral concentration facilities that produce the mineral slurries, and from these slurries the excess water must be removed to acquire the valuable minerals. The dewatering process endeavors to achieve liquid water removal from the concentrated mineral slurry. A goal of the dewatering process is to decrease the residual liquid water content of the starting mineral slurry concentrate. Dewatering additives such as flocculants in combination with an anionic surfactant have been added to concentrated mineral slurries to reduce the liquid water content of the treated slurry being subjected to filtration. In theory, dewatering aids should increase production rates as well as decrease the amount of water present in the filtered ore or mineral cake solids. Because the filtered solids contain less water, the overall production is expected to increase. However, in practice this is not always observed because it produces further requirements of production facility requirements. Traditionally, polymers have been used to agglomerate solids and increase the filtration rate. However, polymers substantially increase the costs. In many instances, the end use or processing of the mineral is detrimentally affected by the higher cost.

There is a need to decrease the cost of the production of minerals, rather than a volume of product. Elimination of the moisture in the filter cake or centrifuge solids increases the amount of mineral or ore solids on a weight percent basis, thereby reducing freight costs required for transport or energy costs for further drying or processing per kilogram of the mineral, or ore solids.

Thus, it is known by those skilled in the art that generally when the moisture content of an aqueous mineral slurry concentrate is beneficially reduced by use of certain additives, a disadvantage also occurs in that the production of the resulting filter cake is decreased at the expense of achieving the beneficial dewatering. None of the background art processes have addressed both the need to reduce the residual liquid water content of the concentrated mineral slurry while simultaneously increasing the production of the mineral concentrate filter cake that results from the water removal process such as for example but not limited to a filtration process.

U.S. Pat. No. 4,207,186 (Wang '186) provides a process for dewatering mineral and coal concentrates comprising mixing an aqueous slurry of a mineral concentrate and an effective amount of a dewatering aid that is a combination of hydrophobic alcohol having an aliphatic radical of eight to eighteen carbon atoms and a nonionic surfactant of the formula R—(OCH.sub.2CH.sub.2).sub.xOH wherein x is an integer of 1-15, R is a branched or linear aliphatic radical containing six to twenty-four carbon atoms in the alkyl moiety, and subjecting the treated slurry to filtration. Wang et al. '186 states that when a hydrophobic alcohol such as decyl alcohol is combined with a nonionic surfactant, lower moisture contents are obtained with iron ore concentrate than had a dewatering aid not been employed. Wang et al. '186, however, is unconcerned with increasing the production of the resulting filter cake.

U.S. Pat. No. 4,210,531 (Wang '531) provides a process for dewatering mineral concentrates which consists essentially of first mixing with an aqueous slurry of a mineral concentrate an effective amount of a polyacrylamide flocculant, and next mixing with the flocculant-treated slurry an effective amount of a combination of an anionic surface active agent composition and a water insoluble organic liquid selected from aliphatic hydrocarbons, aromatic hydrocarbons, aliphatic alcohols, aromatic alcohols, aliphatic halides, aromatic halides, vegetable oils and animal oils, wherein the water-insoluble organic liquid being different from any water-insoluble organic liquid present in the anionic surface active agent composition, and thereafter removing the water as a liquid from the slurry. Wang et al. '531, however, does not address and is unconcerned with reducing the residual liquid water content of the concentrated mineral slurry and increasing the production of the resulting filter cake, nor does it address the expanded costs because of added production requirements.

Additionally, there are fundamental differences in the drying of techniques Wang '186 and Wang '531 because these techniques relate to the drying of coal. The coal drying techniques are different because of the mineral elements of the mineral slurry, as well the origination of the drying process being applied to the mineral slurry concentrate versus coal.

Concurrently, there are known technologies called molecular sieves, including the co-pending patent application Ser. No. 12/924,570 providing for the application of molecular sieves to coal fines. Similar to the shortcomings of Wang '186 and Wang '531 to coal, similar differences exist between the application of molecular sieves to coal fines versus mineral slurry concentrate having mineral slurry contained therein. In addition to the higher starting moisture content of the mineral slurry compared with coal fines, there is also a different moisture distribution between surface moisture and inherent moisture. There are also differences in physical properties of the material science of mineral slurry compared with coal fines, including differences for the processing of the dewatering techniques as described in further detail below. Moreover, there are cost limitations with molecular sieves.

Relative to mining, existing mineral slurry dewatering techniques have limited benefits with large environmental concerns. As such, there exists an economical need for a method and system for drying mineral slurries to reduce the moisture content, thereby improving the harvest of minerals and reducing environmental impact.

Technologies have been explored for drying that involve adsorption of water using desiccants and zeolites. These technologies have only been employed where the use of high temperatures degrade the materials which are sought to be dried, such as foodstuffs and materials that are known to chemically react and/or degrade with heat from the thermal drying process thereby making conventional thermal drying techniques infeasible. For example, U.S. Pat. No. 3,623,233, entitled "Method of Drying a Damp Pulverant," filed Dec. 3, 1969 to Severinghaus describes heat drying of calcite ($CaCO_3$). Severinghaus teaches that heat drying of calcite results in calcination and production of calcine (CaO), which is detrimental to the use of calcite in fillers and extenders. Similarly, U.S. Pat. No. 6,986,213, entitled "Method for Drying Finely Divided Substances," filed Jul. 3, 2003 to Kruithof describes drying foodstuffs such as wheat flour which are degraded using thermal drying techniques. The use of such techniques for drying materials such as mineral slurries that can be dried without degradation using conventional techniques has not been explored.

A longstanding need exists for an economical method and system for drying mineral slurries to reduce the moisture content and to prevent the substantial loss of mineral content in the drying process. Any reduction in moisture thereby increases the cost-effectiveness of mineral slurry processing.

SUMMARY OF THE INVENTION

The present invention provides for a reduction in the residual liquid water content of the concentrated mineral slurry while also providing for an increased production of the filter cake that results from the water removal process, as well as a process for performing dewatering mineral slurry concentrate in a continuous flow operation.

The present invention provides a method and system for drying mineral slurries using granular drying media. As described herein, mineral slurries refers slurries containing minerals in all available sizes. The method and system dries the slurry using any number of known techniques, but may also be performed by combining the slurry concentrate with the granular drying media using the techniques described herein. While in combination, the mineral slurry concentrate and granular drying media mixture is processed to reduce the concentrate moisture, and to maximize surface contact between the granular drying media and the mineral slurry concentrate. As the slurry concentrate contacts the granular drying media, the surface moisture on the minerals within the slurry is then absorbed by the granular drying media. The granular drying media allow for the water molecules to pass into and/or onto them, thus being removed from the slurry. After a period of agitation, the method and system thereby separates the granular drying media from the slurry.

The method and system may use additional techniques for adjusting the volume of mineral slurry concentrate and/or granular drying media, as well as or in addition to adjust the agitation to maximize the percentage of moisture removal. The method and system may also dry the granular drying media to remove the extracted moisture and thus re-use the granular drying media for future moisture removal operations. The method and system may operate to allow further processing of the mineral slurry concentrate after separation from the granular drying media.

Thereby, the method and system improves moisture reduction of mineral slurry concentrate by allowing for the removal of moisture using granular drying media. The utilization of granular drying media significantly reduces processing inefficiencies and costs found in other processing techniques, as well as being environmentally friendly by reducing environment by-products from existing dewatering techniques as well as reducing energy needs for prior heating/drying techniques.

BRIEF DESCRIPTION OF THE DRAWINGS

The invention is illustrated in the figures of the accompanying drawings which are meant to be exemplary and not limiting, in which like references are intended to refer to like or corresponding parts, and in which.

DETAILED DESCRIPTION

Figure 1:
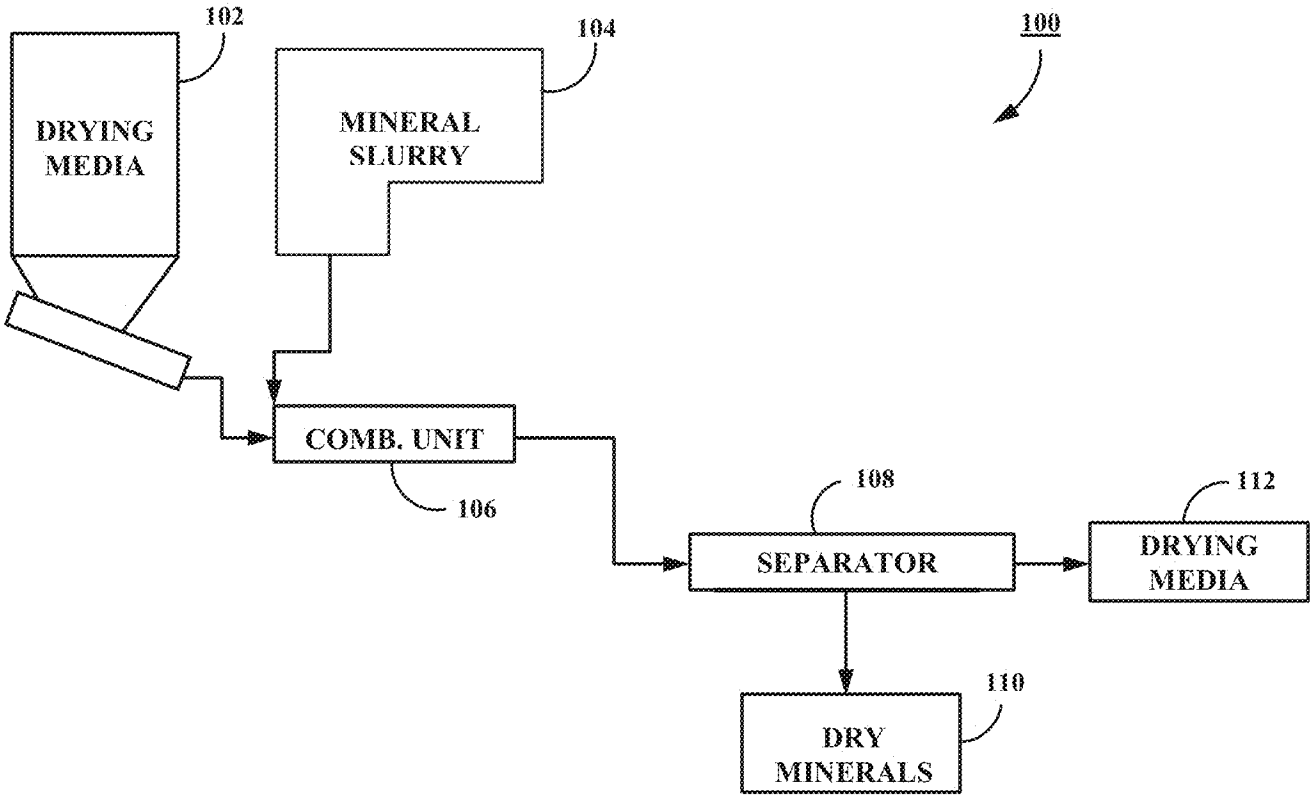
FIG. 1 shows one embodiment of a system for drying mineral slurries.

In the following description, reference is made to the accompanying drawings that form a part hereof, and in which is shown by way of illustration specific embodiments in which the invention may be practiced. It is to be understood that other embodiments may be utilized and design changes may be made without departing from the scope of the present invention.

The minerals for which the present invention is particularly useful are metallic ores and other minerals that do not decompose at thermal drying temperatures. These materials are conventionally dried using thermal drying techniques. The present invention overcomes many of the deficiencies of thermal drying and many benefits of the present invention are realized for such materials.

One particularly preferred mineral which can be beneficially dried using the process of this invention is taconite, which is an iron ore in which the iron minerals are interlayered with quartz, chert, and/or carbonate. Taconite general has iron present in the form of finely dispersed magnetite in a concentration ranging from 25 to 30% of the material. The present invention is useful in drying slurries of taconite mineral before they are processed into taconite pellets. In the process of pelletizing taconite, the ore is ground into a fine powder, the magnetite is separated from the gangue by strong magnets, and the powdered iron concentrate is combined with a binder such as bentonite clay and limestone as a flux. As a last step, it is rolled into pellets about one centimeter in diameter that contain approximately 65% iron. The pellets are fired at a very high temperatures to harden them and make them durable. This is to ensure that the blast furnace charge remains porous enough to allow heated gas to pass through and react with the pelletized ore. The reduction of moisture in a slurry of taconite mineral enables the upgrading of the ore to taconite pellets in an efficient and environmentally sound manner.

Another particularly preferred mineral which can be beneficially dried using the process of this invention is bauxite, which is an aluminum ore. Bauxite is often transported as a mineral slurry in a pipeline from the mine to a site near and aluminum refinery. This type of transportation requires a subsequent dewatering step that is traditionally performed using filtration systems, which are capable of reducing the water content of the resultant material using hyperbaric filtration techniques which was only capable of reducing moisture content to just below 15%, whereas steam pressure filtration was only capable of reducing the water content to just below 12%. See Campos et al., "Determination of a Suitable Dewatering Technology for Filtration of Bauxite after Pipeline Transport," Light Metals 2008. The present invention is capable of further reducing the moisture content of a bauxite mineral slurry to a desired moisture content in an efficient and environmentally sound manner.

The mineral slurry of the present invention may be a mineral slurry that includes one or more of the following mineral components: iron ore, salt, bauxite, phosphates, gypsum, alumina, maganese, aluminum, potash, chromium, kaolin, magnetite, feldspar, copper, bentonite, zinc, barytes, titanium, fluorspar, borates, lead, sulphur, perlite, diatomite, graphite, asbestos, nickel, zirconium, zinc. The present invention is particularly effective where it is desired to remove moisture from a mineral slurry including small particles with corresponding high surface area.

Bulk minerals may be separated into various size components using conventional techniques. Larger size mineral pieces and particles may be separated and dewatered using conventional techniques. Mineral fines may be separated from the bulk water (water in excess of that which is associated with mineral fines when they settle, or are filtered or centrifuged out aqueous suspension) used in the mining/recovery process by any one or more of a variety of known techniques. Such techniques include, but are not limited to one or more of, filtration (e.g., gravity based filtration, or filtration assisted by centrifugal force, pressure or vacuum), settling, centrifugation and the like, which can be used singly or in combination. Further amounts of water may optionally be removed from the mineral fines and/or mineral fines slurry by a second round of such treatments.

After one or more separation steps to remove bulk water, the mineral slurry is then mixed with granular drying medium. The granular drying medium preferably includes particles of a water-collecting material or combination of different types of water-collecting materials, e.g., particles of absorbent or adsorbent, to further reduce the amount of water associated with the fines. In one embodiment, the individual granules of drying medium are large enough to be separated from the particles of the mineral slurry by size (e.g., sifting with an appropriate size screen or mesh). In various embodiments, to facilitate their drying, the mineral slurry is mixed with one or more types of granular drying (i.e., water collecting) materials. The granular drying materials include, but are not limited to, molecular sieves, particles of hydratable polymers (e.g., polyacrylate or carboxymethyl cellulose/polyester particles), or desiccants (e.g., silicates).

The rate at which various water-collecting materials adsorb, absorb, or react with water present in mineral slurry may be affected by temperature. Each type of water-collecting material may have different optimum temperatures for the rate at which they will accumulate water from the mineral slurry. In some instances, as with molecular sieves, heating/warming the molecular sieves with the mineral slurry, or heating/warming molecular sieves immediately prior to mixing them with the mineral slurry, may increase the rate at which water becomes associated with the molecular sieves. In other embodiments, materials such as alumina particles may accumulate water at suitable rate from mineral slurry at room temperature (e.g., about 20-25° C.). Water-collecting materials containing water formerly associated with the mineral slurry can subsequently be removed from the mineral particulate by a variety of means.

FIG. 1 illustrates one embodiment of a system 100 for drying a mineral slurry. The system 100 includes an granular drying medium distribution unit 102, a mineral slurry distribution unit 104, a combination unit 106 and a separator 108. The separator 108 classifies the combination of dried mineral particulate and drying medium into a stream of dried minerals 110 and granular drying media 112.

The system 100 operates to remove moisture from the mineral slurry by contacting the granular drying medium with the mineral slurry. The granular drying medium, as discussed below, is selected based on its ability to adsorb and/or absorb water from the mineral slurry, and is particularly adapted to remove surface moisture from the mineral slurry. By facilitating surface area contact between the granular drying medium and the coal, the moisture is then transferred out of the coal. Based on sizing differences between the granular drying medium and the mineral slurry, the minerals from the slurry may be readily separated from the granular drying medium. Thereby, once the separation occurs, the moisture content of the coal is reduced. The described techniques eliminates the need for energy-intensive drying operations and does not generate any airborne particulates common with the heat-based the drying techniques.

The mineral slurry distribution unit 104 introduces mineral slurry into the process. The mineral slurry to be dried is generated based on the sorting and separation of extracted mineral into various sizes. The mineral slurry may be generated from known sorting techniques of sorting the mineral slurry into smaller and smaller pieces using any number of a variety of techniques, such as multiple screens wherein minerals of smaller sizes fall through screens for separation. In general, the advantages of the present invention become more apparent as the particle size of the mineral to be dried is lowered. Accordingly, the invention is particularly advantageous for mineral slurries having a particle size distribution whereby the mean particle size is 1.5 mm or less. Another suitable measure of mineral distribution benefiting from the present invention is 28 mesh screen or lower, i.e., mineral particulate whereby particles not fitting through a 28 mesh sieve have been excluded. Alternatively, mineral slurries where a substantial fraction of the particles are 28 mesh or lower, or 1.5 mm or less, may be beneficially dried according to the present invention.

The combination unit 106 may be any number possible devices for combining the granular drying medium and the mineral slurry. The combination unit 106 includes functionality for the contacting the mineral slurry with the granular drying medium, plus some degree of agitation. As noted above, the granular drying medium operate by removing surface moisture from the mineral. The present inventors have found that increasing the agitation between the mineral slurry and drying medium accelerates the drying process by improving the surface contact between the minerals and drying medium.

Because moisture in mineral slurry exists predominately as surface moisture, removal of surface moisture effectively lowers the moisture content of mineral slurry. The granular drying medium is selected based on its ability to attract surface moisture away from the mineral surface, thereby overcoming any water that has bonded to surface sites on the mineral particle through, for example, hydrogen bonding or other attractive forces.

The separated granular drying medium can be somewhat dusty and can carry a minute amount of mineral particulate with them after they have absorbed the water. Once separated, the granular drying medium can be passed to a dryer where they can be dried and sufficient moisture is removed to permit their reuse, if desired. Thus, the granular drying medium can be employed in a closed-loop system, where they are mixed with the mineral slurry, and after removing water/moisture (drying) they are separated from the mineral and passed through a dryer and reused.

For example, in one embodiment the combination unit 106 may be a circular tube having a circular channel through which the combined mixture of mineral slurry and granular drying medium pass. This circular tube may be rotated at a particular speed and the tube extended for a particular distance so the mineral slurry and granular drying medium are in contact for a certain period of time. Typically, the longer the contact time between the granular drying medium and the mineral slurry, the more moisture that is removed. One way to increase contact time is to connect two or more combination units in a serial manner. As described in further embodiments below, additional feedback can be implemented to adjust the operating conditions of the combination unit 106 and thus adjust the moisture level of the mineral slurry. The ratio between granular drying medium and mineral slurry may range between 4 parts granular drying medium beads to 1 part mineral slurry to 1 part granular drying medium beads to 1 part mineral slurry, depending on the desired moisture content of the final product.

Another embodiment of the combination unit 106 may be an agitation device or other platform that includes vibration or rotation to increase surface area contact between the mineral slurry and the granular drying medium. Additional examples of the combination unit 106, may be utilized so long as they provide for the above-described functionality of facilitating contact between the mineral slurry and the granular drying medium.

Additional embodiments of mixers may include internal rotor mixers, continuous mixers, blenders, double arm mixers, planetary mixers, ribbon mixers and paddle mixers. Based on the various characteristics of the desiccants and the mineral slurry concentrate, different mixer embodiments provide varying degrees of moisture removal. The various types of mixers allow for customization of the agitation of granular drying medium and mineral slurry concentrate for moisture reduction, as well as processing for the re-usability of the granular drying medium in the continuous flow process.

The separator 108 may be any suitable separation device recognized by one skilled in the art. The separator 108 operates using known separator techniques, including for example in one embodiment vibration and vertical displacement. The separator 108 operates by, in one embodiment, providing holes or openings of an appropriate size that the granular drying medium will not pass through, but the mineral slurry can readily pass. For example, one embodiment may include a high frequency, low amplitude circular screen for filtering the dried minerals from the granular drying medium.

Figure 2:
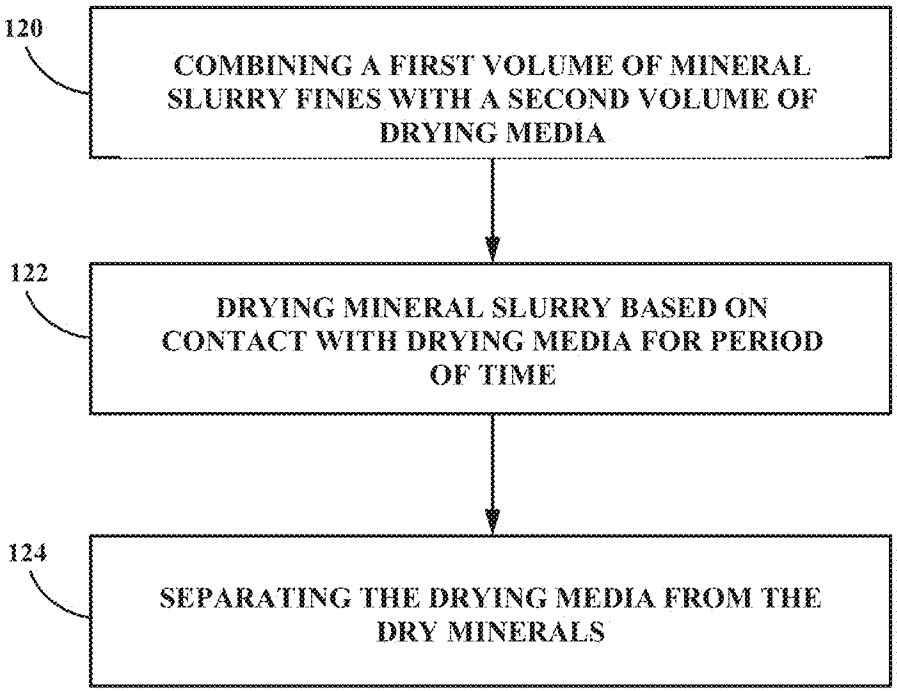
FIG. 2 is a flowchart of steps of one embodiment for drying mineral slurries.

One embodiment of the operation of the system 100 is described relative to the flowchart of FIG. 2. The flowchart of FIG. 2 illustrates the steps of one embodiment of a method for drying a mineral slurry. The method includes the step, 120, of combining a first volume of coal with a second volume of granular drying medium. With respect to the system 100 of FIG. 1, the granular drying medium are dispensed from the granular drying medium distribution unit 102 and the mineral slurry are dispensed from the mineral slurry processing unit 104.

The granular drying medium distribution unit 102 releases a predetermined volume of granular drying medium beads at a predetermined rate. This volume of beads is in proportion to the volume of mineral slurry. As noted above, the ratio of granular drying medium to mineral slurry generally ranges from 4:1 to 1:1. Both units 102 and 104 dispense the corresponding elements into the combination unit 106. One embodiment may rely on gravity to facilitate distribution, as well as additional conveyor or transport means may be used to direct the elements from the distribution units 102 and 104 to the combination unit 106. For example, one embodiment may include conveyor belts to move the mineral slurry and/or granular drying medium into the combination unit 106.

Once the combination unit 106 is charged with granular drying medium and mineral slurry, the next step of the method of FIG. 2 includes drying the mineral slurry based on contacting the granular drying medium and the mineral slurry. As described above, the granular drying medium adsorbs surface moisture from the minerals in the mineral slurry, which is facilitated by the agitation and contact of the mineral slurry with drying media in the combination unit 106. In the example of a rotation assembly, the combination unit 106 may include channels through which the combined granular drying medium and mineral slurry may pass, the assembly being rotated at a predetermined speed. The speed and length of the channels controls the time in which the granular drying medium and mineral slurry are in contact, which directly translates into the corresponding moisture level of the minerals after separation.

After the agitation of mineral slurry and granular drying medium in the combination unit 106, the mixture is passed to the separator 108. In one embodiment, a conveyor belt or any other movement means may be used to pass the mixture to the separator 108. In the method of FIG. 2, a next step, 124, is separating the granular drying medium from the mineral slurry. This step is performed using the separator 108 of FIG. 1. From the separator are split out the coal 110 and the granular drying medium 112. In this embodiment, the method of drying the mineral slurry takes coal from the distribution unit 104, combines it with granular drying media, dries the mineral slurry by transferring moisture from the mineral surface to the granular drying media, followed by separation of the larger diameter granular drying media from the smaller mineral slurry particles based on differences in size. The remaining product of this drying method are minerals 110 having a reduced moisture content level and granular drying medium 112 containing the extracted moisture.

Figure 3:
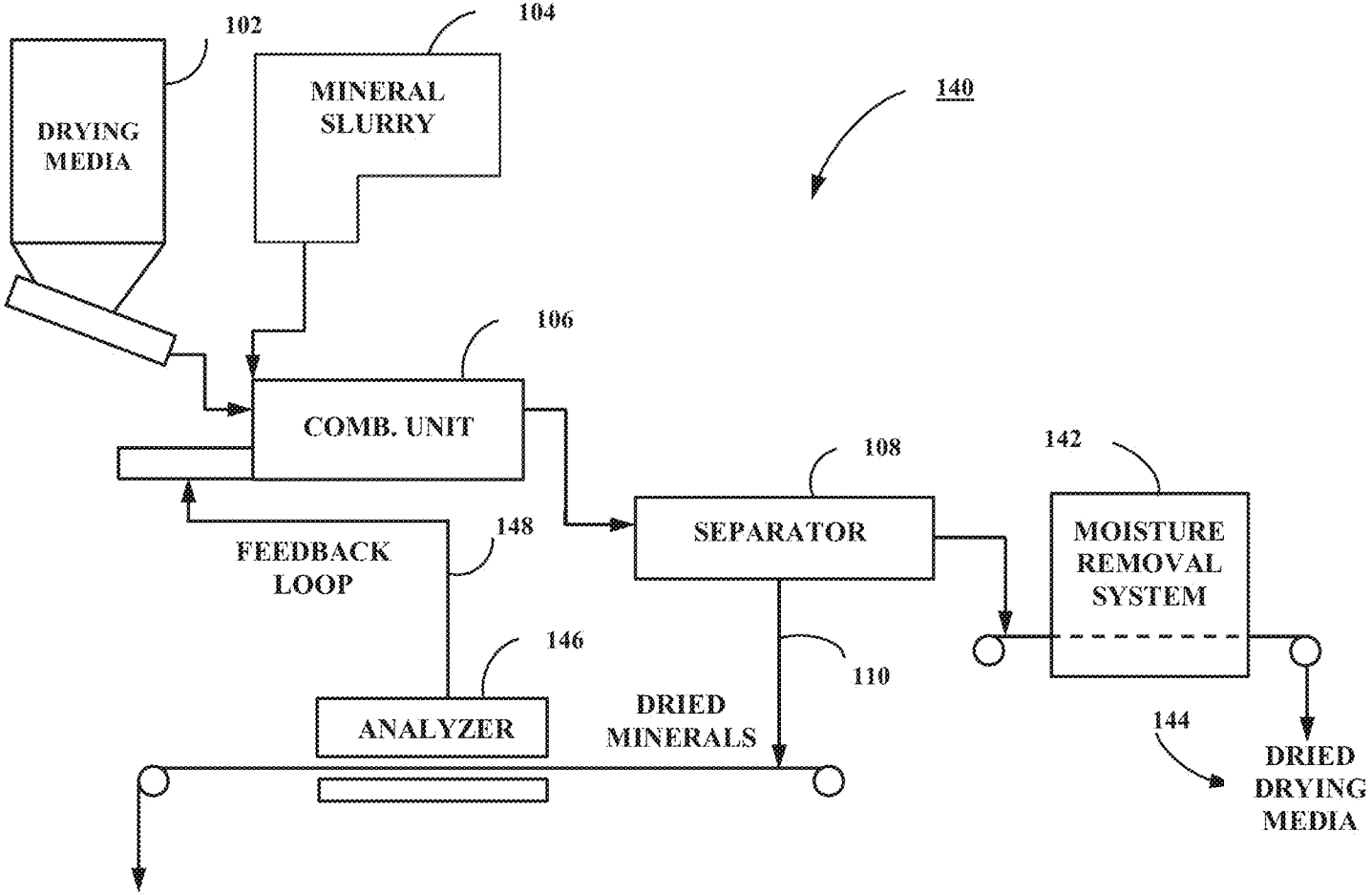
FIG. 3 shows another embodiment of a system for drying mineral slurries.

FIG. 3 illustrates another embodiment of a system 140 for drying a mineral slurry. This system 140 of FIG. 3 includes the elements of the system 100 of FIG. 1, the granular drying medium distribution unit 102, the mineral slurry processing unit 104, the combination unit 106, the separator 108 and the separated mineral slurry 110 and granular drying medium 112, in this embodiment in the form of beads. The system 140 further includes a moisture removal system 142 and dried granular drying medium 144, as well as a moisture analyzer 146 with a feedback loop 148 to the combination unit 106.

Figure 5:
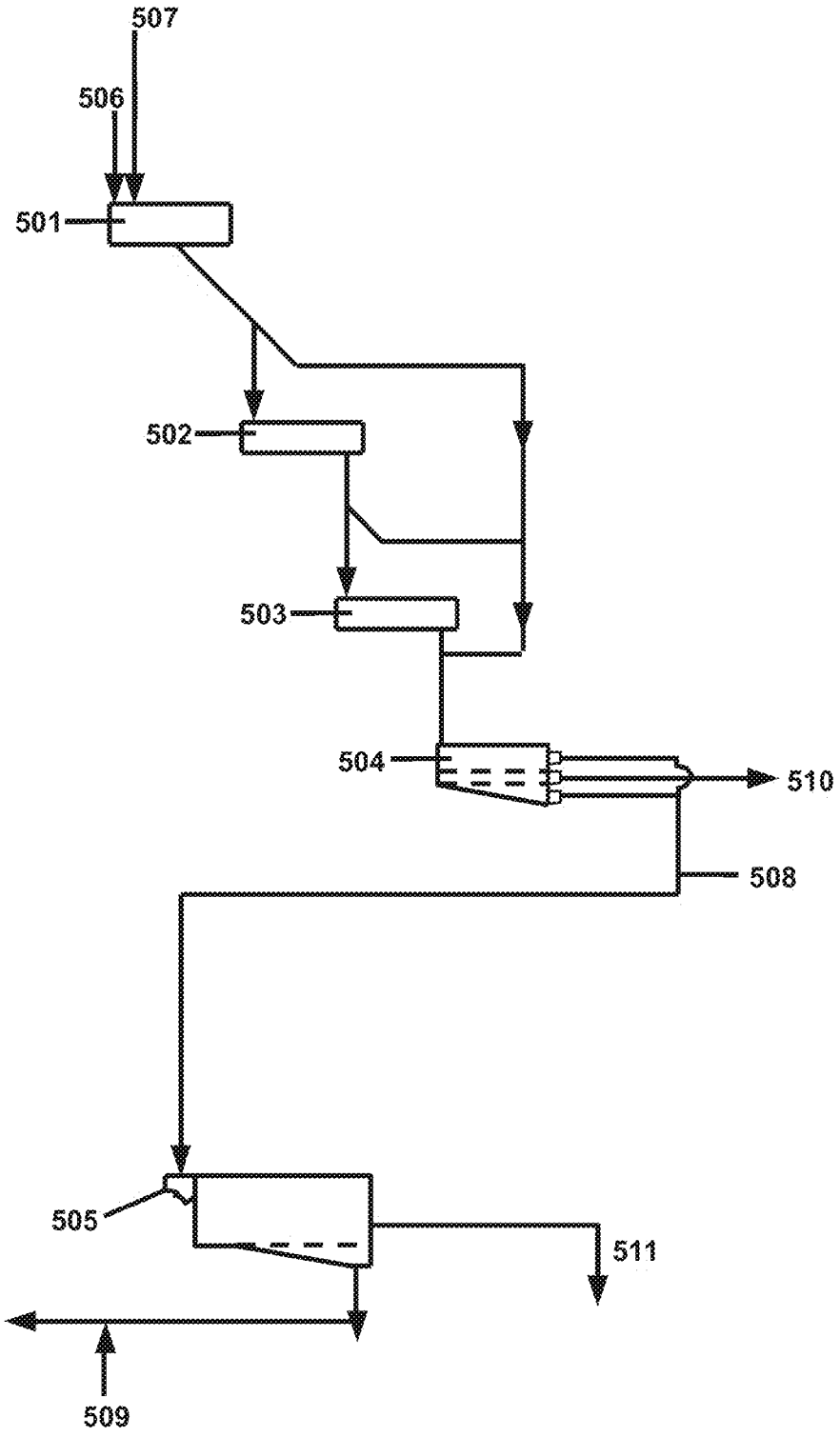
FIG. 5 is a preferred process flow for combining mineral slurry with the granular drying material and separating the wet granular drying material from the mineral slurries.
Figure 6:
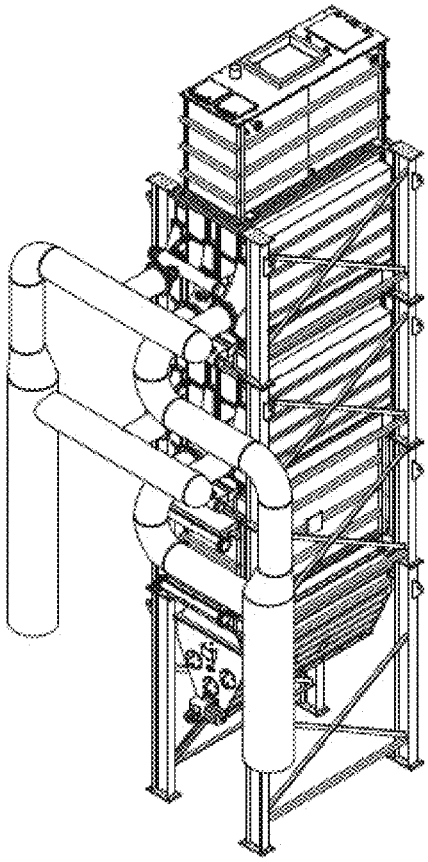
FIG. 6 shows a preferred apparatus for drying granular drying media in a continuous closed loop process.

The moisture removal system 142 is a system that operates to remove the moisture from the granular drying medium 112. In one embodiment, the system 142 may be a microwave system that uses microwaves to dry the sieves. The imposition of microwaves heats up the sieves and causes the evaporation of the water molecules therefrom. The microwave signal strength and duration are determined based on calculations for removing the moisture and can be based on the volume of granular drying medium. For example, the large the volume of granular drying medium, the longer the duration of the drying and/or the higher the power of the microwave may be required. One particularly preferred example of a moisture drying system is shown in FIGS. 5-6 discussed below.

Other embodiments may be utilized for the moisture removal system, wherein other usable systems include operations for removing moisture from the granular drying medium. For example, one embodiment may be a heating unit that uses heat to cause the moisture evaporation. Regardless of the specific implementation, the moisture removal system 142 thereby returns the granular drying medium to a state similar or identical to their state prior to insertion in the combination unit 106 by causing the moisture to be removed and/or eradicated from therefrom, thus generating the dried granular drying medium.

Figure 8:
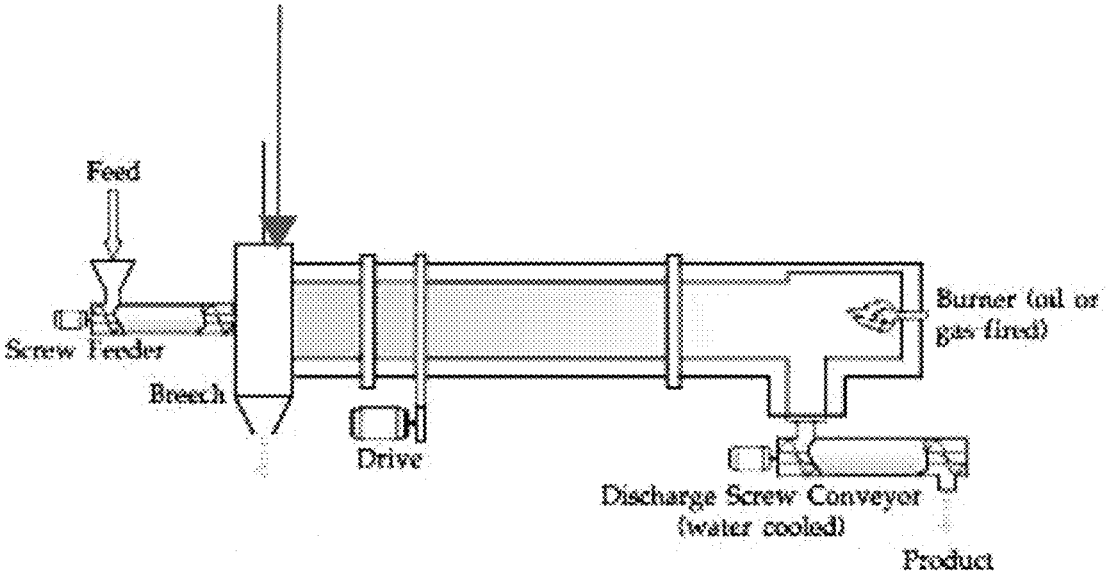
FIG. 8 shows an exemplary apparatus that can be used for drying granular drying media in a continuous closed loop process.
Figure 9:
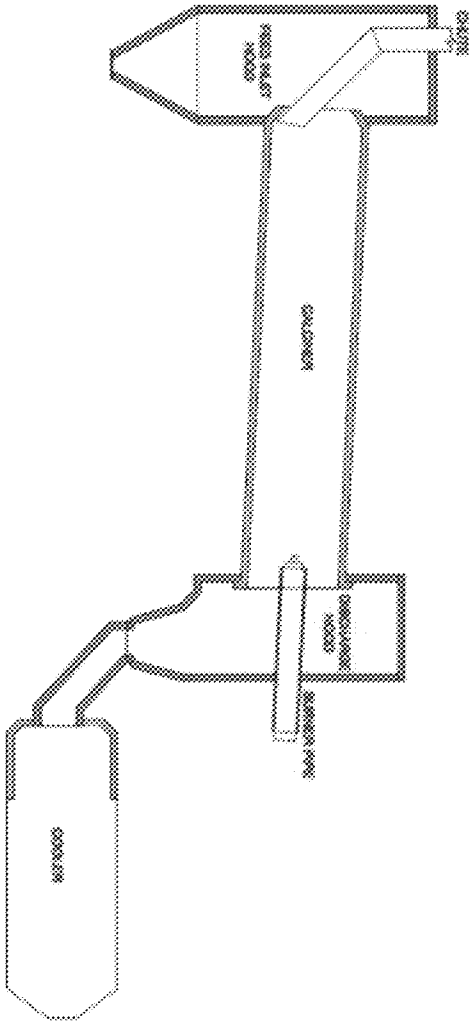
FIG. 9 shows an exemplary apparatus that can be used for drying granular drying media in a continuous closed loop process.
Figure 10:
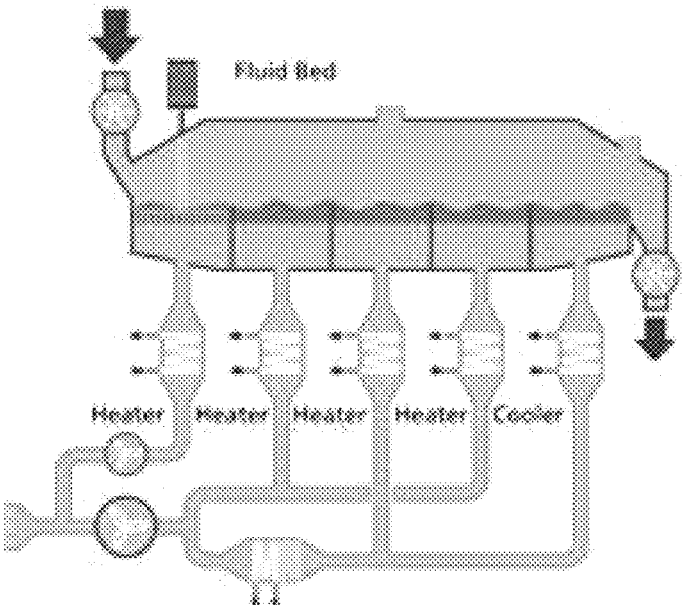
FIG. 10 shows an exemplary apparatus that can be used for drying granular drying media in a continuous closed loop process.
Figure 11:
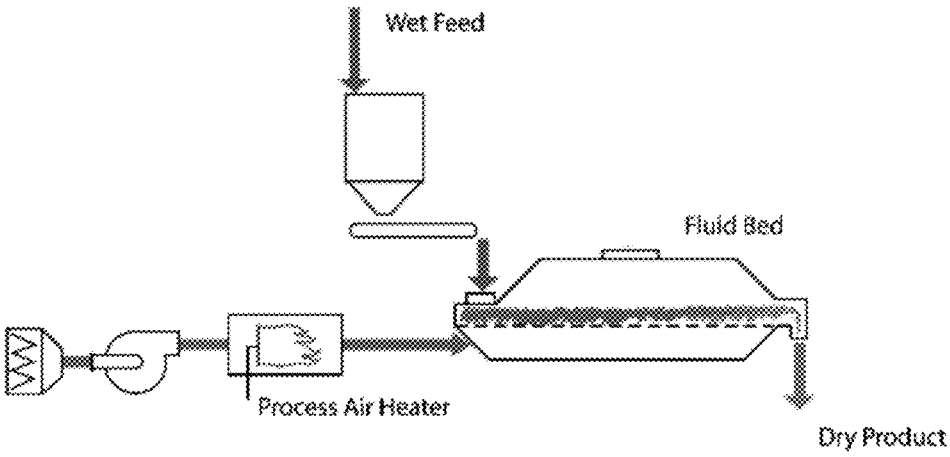
FIG. 11 shows an exemplary apparatus that can be used for drying granular drying media in a continuous closed loop process.

Additional systems for moisture removal from the granular drying media include a heating unit that uses heat to cause the moisture evaporation. Other types of dryers can include direct rotary drying systems, indirect rotary drying systems, catalytic infrared drying systems, bulk drying systems, pressure swing absorption systems, temperature swing absorption systems, aero-flight open chain conveyor drying systems, and, microwave drying systems. Exemplary drying systems that can be used in accordance with the present invention are shown in FIGS. 8-11. FIGS. 8 and 9 show exemplary calciner drying systems. FIGS. 10 and 11 show exemplary fluidized bed drying systems.

The analyzer 146 is a moisture analyzing device that is operative to determine the moisture level of mineral slurry as it passes through the analyzer. The analyzer 146 may be any suitable type of moisture analysis device recognized by one skilled in the art, such as but not limited to a product by Sabia Inc. that uses a prompt gamma neutron activation (PGNA) elemental analysis combined with their proprietary algorithms to measure real time moisture content of a moving stream of coal on a belt using an integrated analyzer feature contained in their SABIA X1-S Sample Stream Analyzer. SABIA Inc. can also provide their coal blending software CoalFusion to further automate the moisture content measurement process.

Figure 4:
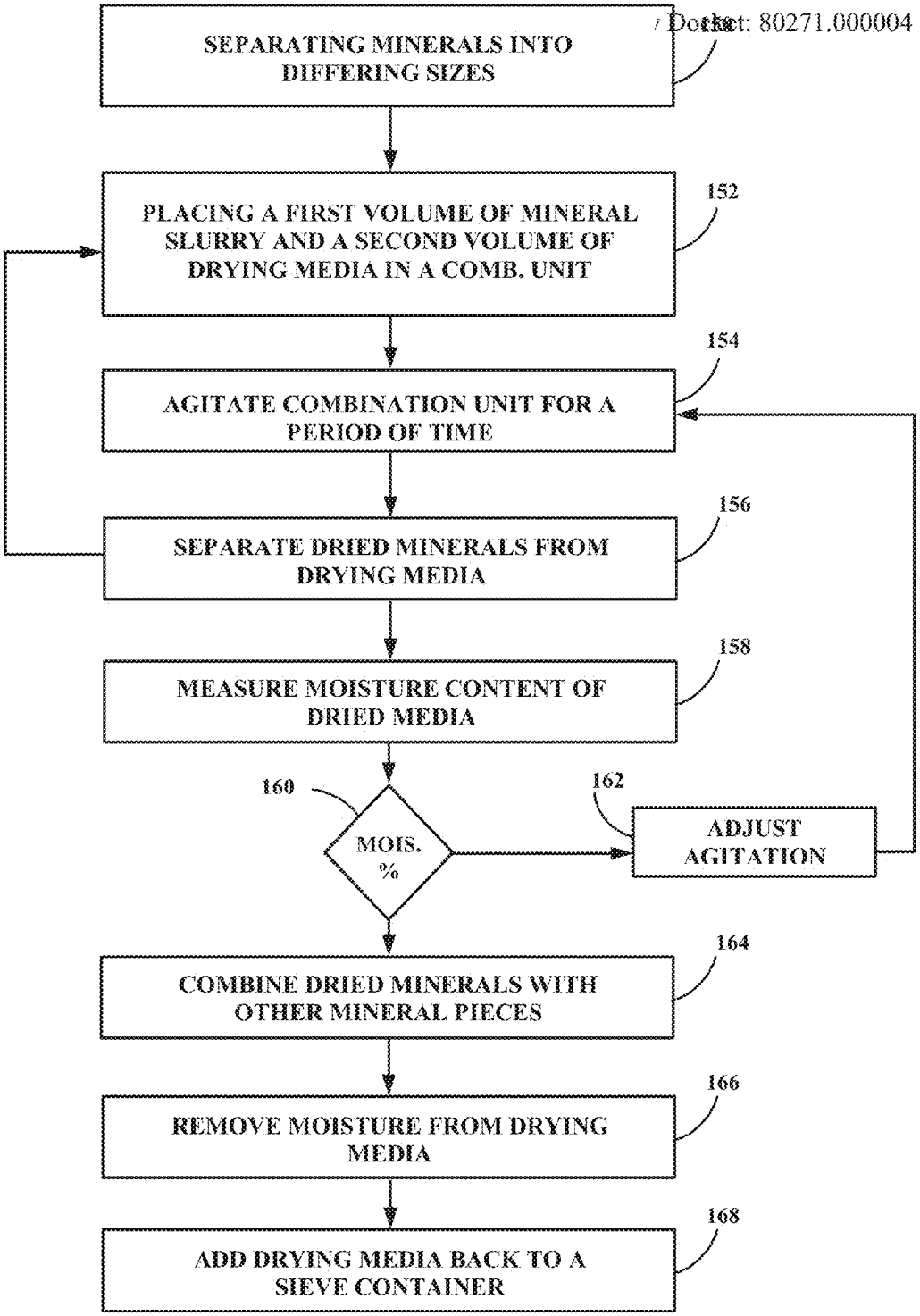
FIG. 4 is a flowchart of steps of another embodiment for drying mineral slurries.

For the sake of brevity, operations of one embodiment of the system 140 are described relative to the flowchart of FIG. 4. FIG. 4 illustrates the steps of one embodiment of drying mineral slurry and including additional processing operations for a continuous mineral slurry drying process using the granular drying medium.

In the process of FIG. 4, a first step, step 150 is separating the mineral slurry into differing sizes including mineral fines. This step may be performed using known separation techniques, separating mineral fines out from larger pieces. For example, the mineral may be separated into categories of greater than a quarter inch, quarter inch to 1.5 mm and 1.5 mm to zero. In this embodiment, the mineral slurry comprising the mineral fines between 28 mesh to zero are provided to the filter cake distribution unit 104. It is recognized that the minerals are not restricted to a sizing of 28 mesh to zero, but rather can be any other suitable sizing, including being further refined into smaller increments, such as 1.5 mm to 28 mesh, 28 mesh to 100 mm, 100 mm to 200 mm, 200 mm to 325 mm and 325 mm to zero, by way of example.

The next steps of the method of FIG. 4 are, step 152, placing a first volume of mineral slurry and a second volume of granular drying medium in the combination unit, step 154, agitating the combination unit, and step 156, separating the mineral slurry from the granular drying medium. These steps may be similar to steps 120, 122 and 124 of FIG. 2.

As illustrated in the system 140 of FIG. 3, the separator 108 separates the granular drying medium from the coal such that the separate elements may be further processed separately. Step 158 of the method includes measuring the moisture content of the mineral slurry using the analyzer 146.

Further illustrated in this embodiment, the system 140 is a continuous flow system such that in normal operations, the method of FIG. 4 concurrently reverts to step 152 for the continued placement of mineral slurry and granular drying medium into the combination unit.

In drying mineral slurries, it is not necessary to completely remove all moisture, but rather drying seeks to achieve a target range of moisture content. This moisture content then translates into an overall moisture content per weight, e.g. tonnage, of mineral.

In one embodiment, following the step of forming an admixture of the mineral slurry with the granular drying material, at least 25% of the water (by weight) in the composition is associated with the water-collecting material. In other embodiments, the amount of water by weight that is associated with the water-collecting material is at least 30%, at least 35%, at least 40%, at least 45%, at least 50%, at least 55%, at least 60%, at least 65%, at least 70%, at least 75%, at least 80%, at least 85%, or at least 90%.

Step 160 is a decision step to determine if the moisture content is above or below a predetermined moisture level. By way of example and not meant to be a limiting value, the combination unit 106 may seek a moisture level at 9.5 percent within a standard deviation range. For example, the final level of moisture in the dried minerals may be between 7.6 and 11.4 percent, preferably between 8.5 and 10.5 percent, and most preferably about 9.5 percent. If the moisture level is above or below that value, step 162 is to adjust the agitation reverting the process back to step 154. Step 162 represents one possible embodiment for adjusting the moisture level, wherein the system 140 is a continuous flow system such that the feedback loop 148 would adjust the combination unit 106 for current mineral slurry drying operations, not the drying of the coal already past the separator 108.

In some embodiments, it may be desirable to reduce the moisture content of the mineral slurry to essentially zero or as close as practically possible to zero. In these cases, it is desirable that the end product comprises approximately 5% moisture by weight or less, preferably approximately 2.5% moisture by weight or less, more preferably 1% moisture by weight or less, and most preferably 0.5% moisture by weight or less.

In one embodiment, the combination unit 106 may be a rotational unit including an actuator that controls the rotational speed. Based on the feedback loop 148, this may increase or decrease the speed. For example, if the moisture level is below the desired percentage, this implies that too much moisture is being removed and therefore the amount of contact between the mineral slurry and granular drying medium is too long such that the rotational speed is increased. Conversely, if the moisture level is too high, this may indicate the desire to slow down the combination unit 106 to increase the amount of surface contact time.

Concurrent with the moisture level measurement by the analyzer 146, the method of FIG. 4 includes combining the dried minerals with other larger mineral pieces, step 164. As described above, the minerals are separated out from other larger mineral pieces. These other larger mineral pieces can be dried using other available less costly means, such as centrifuges, by way of example. For a variety of reasons, complications exist with applying various drying techniques that work with the larger mineral pieces to the mineral slurry, so the mineral slurry separated and dried separately. In step 164, they are recombined for sale.

In the method of FIG. 4, another step, step 166, is the removal of moisture from the granular drying medium. As illustrated in FIG. 3, this may be done using the moisture removal system 142. When the moisture is removed, this generates dried granular drying medium 144, which can then be added back to the sieve distribution unit 102. This allows for re-use of the granular drying medium for continuous drying operations.

With respect to the feedback loop 148, it is recognized that other modifications may be utilized and the feedback is not expressly limited to the combination unit 106. For example, in one embodiment the granular drying medium dispensing unit may include a flow regulator that regulates the volume of granular drying medium released into the combination unit 106. The adjustment of the volume of granular drying medium may be adjusted to change the moisture level of the mineral slurry, such as if there are more granular drying medium, it may provide for reducing more moisture and vice versa. In another embodiment, the feedback loop may provide for adjustment of the dispensing rate of mineral slurry from the mineral slurry distribution device 104.

Thereby, the various embodiments provide methods and systems for drying mineral slurry. The drying utilizes granular drying medium. Prior uses of granular drying medium were related primarily to gas and liquid applications because of the nature of passing molecules between and across the openings in these sieves and therefore was inapplicable to solids, such as to minerals of a mineral slurry. Additionally, prior techniques for drying mineral slurries focused significantly on legacy technologies due to the infrastructure costs for building these drying systems, along with known environmental hazards which are currently permitted, as well as costs associated with trying new technologies. Therefore in addition to the inapplicability of granular drying medium to solids, the mineral slurry processing arts includes an inherent resistance to new technologies for cost and logistical concerns. As described above, the method and system overcome the shortcomings of drying mineral slurries with the application of granular drying medium in a new technological fashion.

FIGS. 1 through 4 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, Applicant does not intend for any term in the specification or claims to be ascribed an uncommon or special meaning unless explicitly set forth as such. Further, the present invention encompasses present and future known equivalents to the known components referred to herein by way of illustration.

I. Continuous Drying of Mineral Slurries with Granular Drying Media

Figure 7:
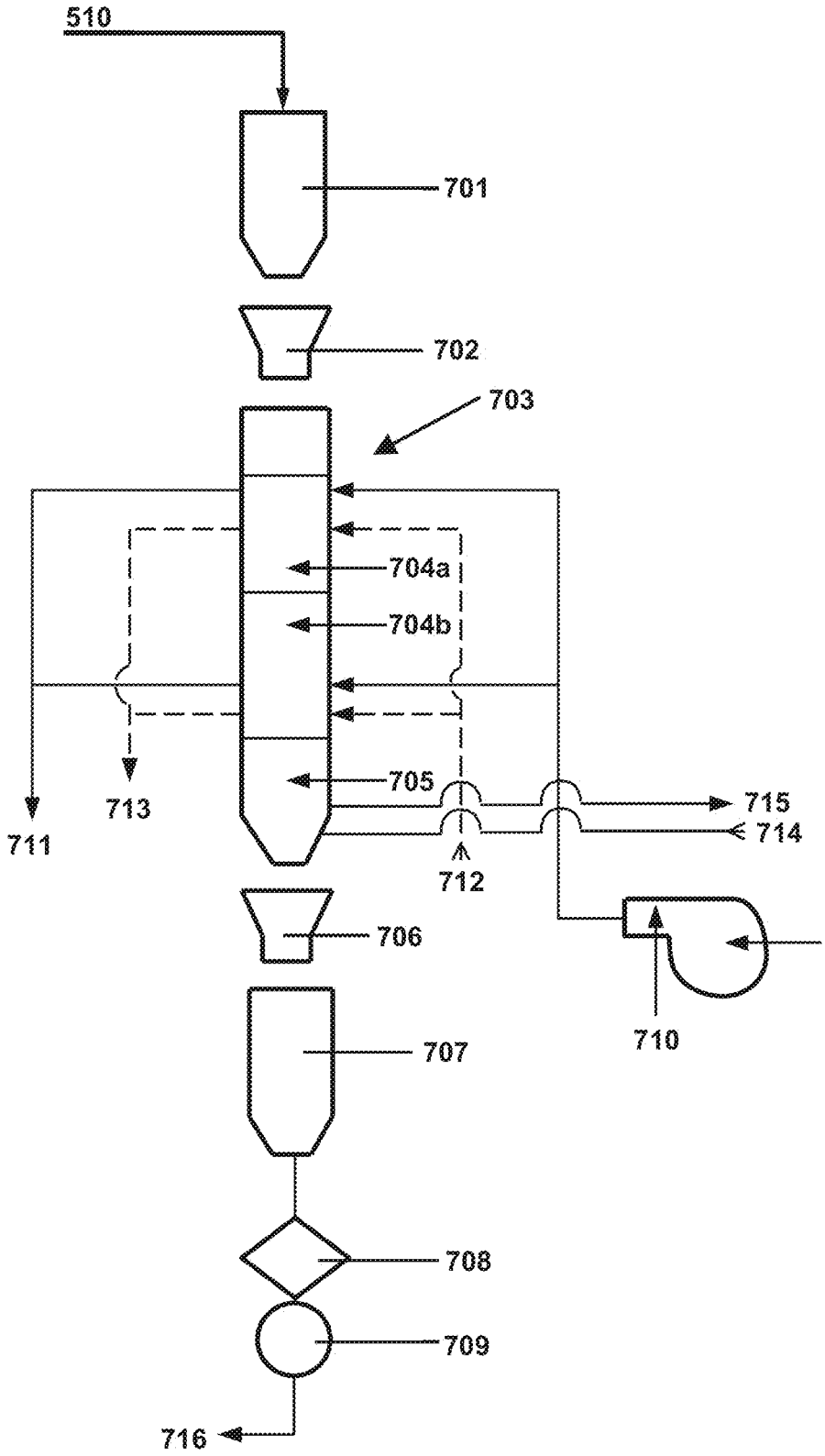
FIG. 7 is the detailed process flow for the preferred apparatus for drying granular drying mediate in a continuous closed loop process.

FIGS. 5-7 illustrate the process flow for a preferred example of a mineral slurry drying process according to the present invention. The overall process utilizes a recirculating loop of granular drying material whereby mineral slurry is continuously fed through the process and contacted with the recirculating loop of granular drying material. This continuous process flow has been found to be particularly desirable for removing moisture from mineral slurries using granules of activated alumina.

FIG. 5 shows first section of the closed loop process for drying mineral slurry using granular drying material. Mineral slurry enters the process in stream 506. The mineral slurry entering the process generally has a particle size distribution and moisture content that will benefit from the drying process of the invention. For example, mineral slurry with a size under 28 mesh and a moisture content greater than 20% is fed into the process at point 506. The mineral slurry entering the process is mixed and/or agitated with granular drying media which in the continuous process exists in stream 507, which is returned after being dried as shown as stream 716 in FIG. 7. Streams 506 and 507 are combined in a paddle mixer 501, which continuously agitates the blend of mineral slurry and granular drying media. If desired, additional paddle mixers may be arranged in a series of paddle mixers, such as the second paddle mixer 502 and third paddle mixer 503 shown in FIG. 5.

When an array of mixers is used as shown in FIG. 5, the sequential mixers are preferably connected with mixer bypass (e.g., a flop gate) so that the mineral slurry and granular drying media can be routed through one, two, three or more mixers to modulate the contact time between the mineral slurry and the granular drying media as desired. Where mineral slurry entering the process has a high water content or is a fine material with a correspondingly large surface area, it may be desired to use the maximum number of mixers in order to increase the contact time. Where the entering mineral slurry is relatively dry to begin with and/or is a rougher grade with lower surface area, it may be desirable to route the mineral slurry and drying media through just one of the mixers. The ability to modulate the number of mixers utilized adds a level of flexibility to the process that may be necessary or desirable in certain circumstances. Additional modulation of the effective contact time between the mineral slurry and granular drying media may be attained through the control of the agitation rate as discussed above.

After mixing, the dried mineral slurry and moist granular drying media are separated using separator 504. The separator 504 can include one or more screens. As shown in FIG. 5, oversized minerals are removed from the beads and fine minerals using the first mesh. The dried minerals are separated from the moist granular drying media, which is routed to a dryer in stream 510. The dried oversized minerals and fine minerals may be recombined in stream 508 and routed to a clean mineral separation unit 505, whereby undersized beads are removed in stream 511 and minerals dried according to the inventive process is removed in stream 509.

The moist granular drying media is routed from the separator 504 to the continuous drying unit (bead regeneration unit 702) in stream 510 as shown in FIGS. 5 and 7. The preferred regeneration unit forces warm air over the moist granular drying material to evaporate and reduce moisture. An example of a preferable bead regeneration unit is shown in FIG. 6. This apparatus is adapted from a dryer that is typically used for grain and processing. The dryer allows the granular drying media to pass slowly downward through a series of heat exchanger plates that are generally oriented vertically. The heating is indirect. The heating fluid (e.g., hot water, steam, or a waste heat stream) flows through the heat exchanger plates, while a cross-flow of air removes moisture from the granular drying media. The moisture content of the regenerated beads can be precisely controlled. The temperature of the cross flow air does not drop as it passes by the granular drying material. By avoiding a temperature drop the air used to dry the bead does not saturate easily. Consequently, the cross-flow air is capable of absorbing a large quantity of moisture. The heating fluid may be a waste stream from a nearby process. Other types of dryers that can be used as bead regenerating units include direct rotary drying systems, indirect rotary drying systems, catalytic infrared drying systems, bulk drying systems, pressure swing absorption systems, temperature swing absorption systems, aero-flight open chain conveyor drying systems, and, microwave drying systems. Exemplary drying systems that can be used in accordance with the present invention are shown in FIGS. 8-11. FIGS. 8 and 9 show exemplary calciner drying systems. FIGS. 10 and 11 show exemplary fluidized bed drying systems.

The granular drying media enters the drying unit in stream 510 as shown in FIG. 7. The granular drying media is fed via a letdown chute to a wet bead surge bin 701. From the surge bin the material is fed into the bead regeneration unit 703 using a centrifeeder 702. As the wet granular drying material is fed through the regeneration unit 703, the material is dried. A heating fluid stream 712 is routed through heat exchanger plates (not shown) of the bead regeneration unit 703 and exits at stream 713. Drying air is routed from a blower 710 through the bead regeneration unit and exits at stream 711. The drying air removes moisture from the moist granular drying media. The beads exit the regeneration unit 703 via a cooling section which is cooled using a stream 714 of cooling fluid that exits the regeneration unit 703 in stream 715. The beads are then fed through a centrifeeder 706 into a dry feed bin 707 via a letdown chute. The dried granular drying media are then loaded into a surge hopper 708 then to a densiveyor 709 and fed back to the beginning of the process in stream 507 as shown in FIGS. 5 and 7.

The continuous process according to the present invention drastically reduces the relative cost of drying mineral slurries relative to thermal drying. The most significant efficiencies come through the reduced amount of fuel and electricity needed to dry moist mineral slurries relative to conventional thermal drying processes. As shown, the total cost of drying mineral slurry using the continuous process of the present invention is estimated to be under 35% of the cost of using a thermal dryer. In addition, the present continuous process is vastly cleaner than the use of a thermal dryer as shown in FIG. 13. The reduction in combustion byproducts such as CO, NOx, SO2 and volatile matter is significant relative to thermal drying the mineral slurry.

II. Granular Drying Media

Several types of granular drying media have been found efficacious for drying mineral slurries. As noted above, the preferred granular drying media can absorb significant quantities of water (e.g., up to 28% of its own weight), is capable of withstanding agitation in a particulate mineral slurry for several cycles, is readily separated from dried minerals including mineral fines, has a large capacity to remove water from the mineral particulate surface, and can be regenerated without requiring excessive energy. Preferred granular media according to the present invention are zeolites and desiccants, including preferably activated alumina. The process when used with a preferred granular drying media will provide one or more desirable benefits such as a reduction in one or more of time, energy, cost, and/or adverse environmental impact, as compared to conventional processes for drying mineral slurries.

Although embodiments described herein do not require the drying and reuse of granular drying media, it is desirable that the granular drying media is reused one or more times. Embodiments described herein thus employ the drying and reuse water-collecting materials such as absorbents and adsorbents. In other embodiments all or a portion of the water-collecting material can be discarded, e.g., where an absorbent is degraded and cannot be effectively separated from the minerals. In one embodiment, particles of water-collecting materials are separated by sieving or sifting to remove degraded particles which may be larger than particles of minerals, but are smaller than desirable for processing mineral slurry fines. In other embodiments, some or all of the absorbent materials employed for use in removing moisture from mineral slurry fines may be biodegradable. The water-collecting material also may bond with the water to cause the water to be associated with the material instead of the mineral fines.

The granular drying media of the present invention desirably results in low attrition rates when utilized in a continuous process of mineral slurry moisture reduction.

A. Molecular Sieves

Molecular sieves are materials containing pores of a precise and uniform size (pore sizes are typically from about 3 to about 10 Angstroms) that are used as an adsorbent for gases and liquids. Without wishing to be bound by any theory, generally molecules small enough to pass through the pores are adsorbed while larger molecules cannot enter the pores. Molecular sieves are different from a common filter in that they operate on a molecular level. For instance, a water molecule may not be small enough to pass through while the smaller molecules in the gas pass through. Because of this, they often function as a desiccant. Some molecular sieves can adsorb water up to 22% of their dry weight. Molecular sieves often include aluminosilicate minerals, clays, porous glasses, microporous charcoals, zeolites, active carbons (activated charcoal or activated carbon), or synthetic compounds that have open structures through or into which small molecules, such as nitrogen and water can diffuse. In some embodiments, the molecular sieves are an aluminosilicate mineral (e.g., andalusite, kyanite, sillimanite, or mullite). In other embodiments, the molecular sieves comprise about 10%, 20%, 30%, 40%, 50%, 60%, 65%, 70%, 75%, 80%, 85%, 90%, 95%, 98%, 99% or greater (on a weigh basis) of an aluminosilicate mineral. In some embodiments, including those embodiments where the molecular sieves comprise an aluminosilicate mineral, the particles of molecular sieves may contain other minerals, such oxides of zirconium or titanium to enhance properties such as strength and wear (e.g., zirconia toughened aluminosilicates or alumina-titanate-mullite composites). In some embodiments the molecular sieves are 3 angstrom molecular sieves (e.g., MS3A4825 molecular sieves with 2.5-4.5 mm bead size and 14 lb crush strength from Delta Enterprises, Roselle, Ill.) or 4 angstrom molecular sieves (e.g., MS4A4810 molecular sieves with 2.5-4.5 mm bead size and 18 lb crush strength from Delta Enterprises, Roselle, Ill.).

A variety of molecular sieves can be employed alone or in combination to remove water or moisture from mineral slurry fines. In one embodiment, molecular sieves may be selected from aluminosilicate minerals, clays, porous glasses, microporous charcoals, zeolites, active carbons, or synthetic compounds that have open structures through or into which small molecules, such as nitrogen and water can diffuse. In other embodiments, molecular sieves may be selected from aluminosilicate minerals, clays, porous glasses, or zeolites.

Molecular sieves with pores large enough to draw in water molecules, but small enough to prevent any of the mineral slurry fines from entering the sieve particles, can be advantageously employed. Hardened molecular sieves or molecular sieves, or those with an especially hard shell, are useful in the methods described herein as such sieves will not be readily worn down and can be reused after removal of moisture.

In some embodiments molecular sieve particles are greater than 1, 1.25, 1.5, 1.75, 2.0, 2.25 or 2.5 mm in diameter and less than about 5 mm or 10 mm. In other embodiments the molecular sieve particles are greater than about 12, 14, 16, 18, 20, 22, 24 or 26 mm in diameter and less than about 28, 30 or 32 mm in diameter. When mixed with the mineral slurry fines having excess moisture, the molecular sieves quickly draw the moisture from the mineral slurry fines. As the sieves are larger than the mineral slurry fines (e.g., over a millimeter in diameter), the mixture of sieves and mineral slurry fines can be lightly bounced on a fine mesh grid, where the dry mineral slurry fines can be separated from the molecular sieves. The separated molecular sieves can be a bit dusty and can carry a minute amount of mineral slurry fines with them after they have absorbed the water. Once separated, the molecular sieves can be passed to a heater where they can be dried and sufficient moisture is removed to permit their reuse if desired. Thus, the molecular sieves can be employed in a close-loop system, where they are mixed with the mineral slurry fines, and after removing water/moisture (drying) they are separated from the mineral slurry fines and passed through a heater and reused. Minimal agitation is required during dry the sieves.

B. Hydratable Polymeric Materials

Hydratable polymeric materials or compositions comprising one or more hydratable polymers may be employed to reduce the moisture content of mineral slurry fines (e.g., polyacrylate or carboxymethyl cellulose/polyester particles/beads).

In one embodiment the hydratable polymeric materials is polyacrylate (e.g., a sodium salt of polyacrylic acid). Polyacrylate polymers are the superabsorbents employed in a variety of commercial products such as in baby's diapers, because of their ability to absorb up to 400% of their weight in water. Polyacrylates can be purchased as a come a translucent gel or in a snowy white particulate form. Suitable amounts of polyacrylic acid polymers (polyacrylates) sufficient to adsorb the desired amounts of water from mineral slurry fines can be mixed with the fines, to quickly dry mineral slurry. The polyacrylate, which swells into particles or "balls," may be separated from the mineral slurry fines on suitable size filters or sieves. The particles or "balls" can either be discarded or recycled by drying using any suitable method (direct heating, heating by exposure to microwave energy, and the like).

The properties of hydrateable polymers, including polyacrylate polymers, may be varied depending on the specifics of the process being employed to dry the mineral slurry fines. A skilled artisan will recognize that the properties (gel strength, ability to absorb water, biodegradability etc.) are controlled to a large degree by the type and extent of the cross-linking that is employed in the preparation of hydratable polymers. A skilled artisan will also recognize that it may be desirable to match the degree of cross-linking with the mechanical vigor of the process being used dry the mineral slurry fines and the number of times, if any, that the particles are intended to be reused in drying batches of mineral slurry fines. Typically, the use of more cross-linked polymers, which are typically mechanically more stable/rigid, will permit their use in more mechanically vigorous processes and the potential reuse of the particles.

In another embodiment the hydratable polymer composition employed is a combination of carboxymethylcellulose (CMC) and polyester (e.g., CMC gum available from Texas Terra Ceramic Supply, Mount Vernon, Tex.). Such compositions, or other super adsorbent hydratable polymeric substances, can be used to remove water from mineral slurry fines in a manner similar to that described above for molecular sieves or polyacrylate polymer compositions.

C. Desiccants

In other embodiments, desiccants are used as water-collecting materials to dry mineral slurry fines. A variety of desiccation agents (desiccants) may be employed to reduce the moisture content of mineral slurry fines including, but not limited to, silica, alumina, and calcium sulfate (Drierite, W. A. Hammond Drierite Col Ltd Xenia, Ohio) and similar materials. Desiccants, like the compositions described above can be used to remove water from mineral slurry fines in a manner similar to that described above for molecular sieves or polyacrylate polymer compositions.

In some embodiments, the desiccant material is comprised of activated alumina, a material that is effective in absorbing water. Without wishing to be bound by any theory, activated alumina's efficiency as a desiccant is based on the large and highly hydrophilic surface area of activated alumina (on the order of 200 $m^2/g$) and water's attraction (binding) to the activated alumina surface. Other materials having high-surface areas that are hydrophilic are contemplated, e.g., materials that have hydrophilic surfaces and surface areas greater than 50 $m^2/g$, 100 $m^2/g$ or 150 $m^2/g$. In some embodiments the desiccant comprises about 10%, 20%, 30%, 40%, 50%, 60%, 65%, 70%, 75%, 80%, 85%, 90%, 95%, 98%, 99% or greater (on a weigh basis) of alumina.

D. Activated Alumina

Activated alumina is a very hard, durable ceramic capable of withstanding significant abrasion and wear, however, the wear resistance and mechanical properties of activated alumina may be enhanced by introducing other materials into particles of water-collecting materials that comprise alumina. In some embodiments, desiccants comprising alumina may contain about 0.5%, 1%, 2%, 3%, 4%, 5%, 6%, 7%, 8%, 9%, 10%, 15%, 20%, 25%, 30%, 40%, 50%, 60%, 70%, 80%, or 90% or more of other minerals, such oxides of zirconium or titanium to enhance properties such as strength and wear (e.g., zirconia alumina or zirconia toughened alumina ZTA).

Activated alumina has been found to provide advantages relative to the use of molecular sieves. The surface of activated alumina is hydroxylated which strongly attracts water to its surface and associates water through hydrogen bonding. This provides certain advantages relative to molecular sieves discussed in prior co-pending U.S. patent application Ser. No. 12/924,570 describes processing coal fines using varying desiccants, including molecular sieves.

Activated alumina is manufactured from aluminium hydroxide by dehydroxylating it in a way that produces a highly porous material; this material can have a surface area significantly over 200 square meters/g. It is made of aluminium oxide (alumina; Al2O3). It has a very high surface-area-to-weight ratio. The porous nature of activated alumina exhibits tunnel-like structures running throughout the particle which allow absorption of significant moisture to the porous surface.

Activated alumina with pores large enough to draw in water molecules, but small enough to prevent any of the mineral fines from the slurry from entering the particles, can be advantageously employed. Hardened activated alumina also provide the benefit of not breaking down as easily and are readily re-usable once the absorbed water is removed, as described below. In another embodiment, the activated alumina may include magnetic properties for separation from the mineral slurry using magnetic forces, if applicable. Alternatively, the activated alumina is provided in its natural non-magnetic state while the ore of the mineral slurry is itself magnetic. In this case, the dried ore may be separated from the wet activated alumina using magnetic attraction of the ore relative to the activated alumina. Other granular drying media which does not have magnetic properties may be separated from a mineral slurry having magnetic properties using these same principles.

A variety of activated alumina can be employed alone or in combination to remove water or moisture from mineral slurry as described in further detail below. Hardened granular drying medium also provide the benefit of not breaking down as easily and are readily re-usable once the absorbed water is removed, as described below.

In some embodiments activated alumina particles, in the form of beads, are greater than 1, 1.25, 1.5, 1.75, 2.0, 2.25 or 2.5 mm in diameter and less than about 5 mm or 10 mm. When mixed with the wet mineral slurry having excess moisture, the activated alumina quickly draw the moisture from the mineral slurry. As the particles are larger than the mineral slurry (e.g., over a millimeter in diameter), the mixture of activated alumina and mineral slurry can be readily separated based on size.

A particularly desirable activated alumina particle for use as a granular drying media in accordance with the present invention is a spherically-shaped activated alumina spheres. The activated alumina particles preferably have a uniform size and sphericity that makes subsequent separation of these particles from the mineral slurry particularly efficient. The diameter of the alumina particles preferably range from approximately 0.1 mm to 10 mm in diameter, preferably approximately 2.0 mm to approximately 4.7 mm, more preferably between about 3.0 and about 3.4 mm, and most preferably about 3.2 mm. The activated alumina also preferably has a high crush strength which allows for lower attrition and longer use. For example, the crush strength is greater than 25 lbf, more preferably about 30 lbf, and most preferably 35 lbf or more. The activated alumina preferably has a large surface area, which is preferably greater than 340 $m^2/g$ and most preferably about 350 $m^2/g$. In general, the pore volume is about 0.5 cc/g, the bulk density is 48 lbs/ft3 (769 $kg/m^3$), the crust strength is 30 lbs (14 kg) and abrasion loss is preferably less than 0.1 wt %.

E. Dimensions of Granular Drying Material

As described above, a variety of water-collecting materials may be employed in systems for removing water from wet (or moist) mineral slurry fines. Such water-collecting materials include those that absorb water, those that adsorbs water, and those that bonds or react with water. Typically the water-collecting materials will be in the form of particles that can be of any shape suitable for forming an admixture with the wet (or moist) mineral slurry fines and that are capable of being recovered. Such particles may be irregular in shape, or have a regular shape. Where particles are not irregular in shape they may be of virtually any shape. In one embodiment, particles that are generally or substantially spherical, or generally or substantially oblate, or prolate may be employed. Suitable particle shapes also include cylindrical or conical particles, in addition to regular polygons such as icosahedral particles, cubic particles and the like. During use and reuse the particles may become abraded altering their shape.

Particles for use in the methods and systems for removing water (e.g., reducing the moisture content) of from mineral slurry fines described herein can be of a variety of sizes. In one embodiment, where the water-collecting materials are in the form of particles, the particles have an average size that is at least: 2, 3, 4, 6, 7, 8, 9, 10, 12, 14, 16, 18, 20, 25, or 30 times greater than the average size of the mineral slurry fines, which are typically in the range of 100 to 800 microns. In one embodiment the difference in size is based upon the difference in the average size of the largest dimension of the particles and mineral slurry fines.

Particles of water-collecting materials, including those that are spherical or substantially spherical, may have an average diameter (or largest dimension) that is at least: 1, at least 1.25, at least 1.5, at least 1.75, at least 2.0, at least 2.25, at least 2.5 mm, or at least 4 mm where the average diameter (or largest dimension) is less than about 5 mm, 7.5 mm, 10 mm or 15 mm. In another embodiment, the systems may employ particles that have an average diameter (or largest dimension) that is greater than about 4, 5, 6, 8, 10, 12, 14, 16, 18, 20, 22, 24 or 26 mm and less than about 28, 30 or 32 mm.

In embodiments where particles have an irregular shape, or are not spherical or substantially spherical, they may have a largest dimension that is at least: 1, at least 1.25, at least 1.5, at least 1.75, at least 2.0, at least 2.25, at least 2.5 mm, or at least 4 mm, and less than about 5 mm, 7.5 mm, 10 mm or 15 mm. In another embodiment, the methods and systems described herein may employ irregular or non-spherical particles that have a largest dimension that is greater than about one of 4, 5, 6, 8, 10, 12, 14, 16, 18, 20, 22, 24 or 26 mm and less than about one of 28, 30 or 32 mm.

In one embodiment the water-collecting materials are desiccants, such as activated alumina desiccants, which are manufactured in multiple forms. In some embodiments the desiccants particles used for water-collecting materials, which may be spherical or substantially spherical, are greater than about 1, 1.25, 1.5, 1.75, 2.0, 2.25 or 2.5 mm in diameter and less than about 5 mm or 10 mm in diameter. In other embodiments the desiccant particles have an average diameter or greatest dimension that is greater than about 4, 5, 6, 8, 10, 12, 14, 16, 18, 20, 22, 24 or 26 mm in and less than about 28, 30 or 32 mm. In one set of embodiments the desiccant particles are spheres (or substantially spherical) with diameters (e.g., average diameters) in those size ranges. In other embodiments, the desiccant particles are spheres (or substantially spherical) in sizes up to or about 6 mm in diameter. In other embodiments the desiccants are spherical or substantially spherical particles comprised of alumina having a size in a range selected from: about 2 mm to about 4 mm, about 4 mm to about 8 mm, about 8 mm to about 16 mm, about 16 mm to about 32 mm, about 5 mm to about 10 mm, about 8 mm to about 20 mm, and about 16 mm to about 26 mm. In still other embodiments, the water collecting materials are spherical or substantially spherical alumina particles having an average diameter of about: 4, 6, 8, 10, 12, 14, 16, 18, 20, 22, 24, 26, 28, 30, or 32 mm.

F. Separation by Size and/or Magnetic Means

Water-collecting materials may be separated from mineral slurry fines by any suitable technique including filtering, sieving or sifting, or the use of a stream of gas to carry mineral slurry fines away from larger and/or heavier particles water-collecting materials.

The separation of all types of water-collecting materials (e.g., molecular sieves, desiccants, or hydratable polymers) may also be accomplished using magnetic separation equipment where the water-collecting materials comprise material capable of, or susceptible to, being attracted by a magnet. Materials that render water-collecting materials capable of being attracted by a magnet include magnetic material and ferromagnetic material (e.g., iron, steel, or neodymium-iron-boron). Water-collecting materials need only comprise sufficient magnetic materials to permit their separation from mineral slurry fines. The amount of magnetic material employed permit the separation of water-collecting particles from mineral slurry fines will vary depending on, among other things, the strength of the magnet, the size of the particles, and the depth of the bed of mineral slurry fines from which the particles are to be collected. The amount of magnetic material may be greater than about 10%, 20%, 30%, 40%, 50%, 60%, 65%, 70%, 75%, 80%, 85%, or 90% of the total weight of the water-collecting material on a dry weight basis. In some embodiments the magnetic materials will be iron or an iron containing material such as steel.

Regardless of the magnetic material employed to render water-collecting materials susceptible to magnetic collection, the magnetic materials may be arranged in the water-collecting material as a solid core or as dispersed particles or layers within the water-collecting materials. Where dispersed particles employed are employed, they may be spread uniformly throughout the water-collecting material. In one embodiment the magnetic material is comprises iron containing particles that are admixed with water-collecting materials such as alumina or mullite prior to forming into pellets that will fired into a ceramic type of material. In still other embodiments the water-collecting materials may contain layers of materials that render the particles susceptible to attraction by a magnet (e.g. iron or steel). Examples of magnetic alumina particles that may be used as water-collecting materials may be found in U.S. Pat. No. 4,438,161 issued to Pollock titled Iron-containing refractory balls for retorting oil shale.

Example 1

Mineral slurry fines (15 g) with a moisture content of 30% by weight are mixed with molecular sieves having a pore sizes of 3 angstroms (15 g, product MS3A4825 2.5-4.5 mm bead size from Delta Adsorbents, which is a division of Delta Enterprises, Inc., Roselle, Ill.) for about 60 minutes thereby drying the mineral slurry fines to <5% moisture by weight. After separating the mineral slurry fines from the sieves by sifting, the molecular sieves are weighed and dried in a 100° C. oven. The mineral slurry fines are weighed periodically to determine the length of time necessary to drive off the water absorbed from the mineral slurry. The data is plotted for the first batch of mineral slurry. The process is repeated using the same molecular sieves with a second through sixth batch of mineral slurry fines.

Example 2

Mineral slurry fines (15 g) with a moisture content of 30% by weight are mixed with a polyacrylate polymer (0.5 g Online Science Mall, Birmingham, Ala.) for about 1 minute thereby drying the mineral slurry fines to <5% moisture by weight. After separating the mineral slurry fines from the polymer gently sifting the mix, the molecular polyacrylate polymer particles are recovered for reuse after drying.

Example 3

Mineral slurry fines (100 g) with a moisture content of 21% by weight are mixed with activated alumina beads (6 mm diameter, AGM Container Controls, Inc, Tucson, Ariz.) for about 10 minutes, thereby drying the mineral slurry fines to about 7% moisture by weight. After separating the mineral slurry fines from the polymer gently sifting the mix, the activated alumina beads are recovered for reuse after drying.

The foregoing description of the specific embodiments so fully reveals the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein.

What is claimed is:

1. A method for reducing mineral slurry moisture comprising:

(a) contacting a first volume of mineral slurry with a second volume of granular drying media;

(b) reducing the moisture content of the mineral slurry by transferring moisture from minerals in the mineral slurry to the granular drying media; and (c) separating the granular drying media from the minerals by difference in particle size, wherein the mineral slurry comprises a mineral that does not decompose at thermal drying temperatures, wherein the process is continuous and at least a portion of the second volume of granular drying media is subjected to a step (d) of regenerating the granular drying media after step (c).

2. The method of claim 1, wherein the first volume of mineral slurry has greater than 10% of particles of a diameter less than the average diameter of the granular drying media.

3. The method of claim 1, wherein the first volume of mineral slurry has greater than 10% of particles smaller than 28 mesh.

4. The method of claim 1, wherein the first volume of mineral slurry has greater than 50% of particles smaller than 28 mesh.

5. The method of claim 1, wherein the first volume of mineral slurry has greater than 80% of particles smaller than 28 mesh.

6. The method of claim 1, wherein the moisture content of the first volume of mineral slurry is greater than 20% by weight, and the moisture content of the mineral slurry is less than 10% by weight after step (c).

7. The method of claim 1, wherein the granular drying media is spherical has a mean particle diameter ranging from approximately 2.0 mm to approximately 4.7 mm.

8. The method of claim 1, wherein the granular drying media is spherical has a mean particle diameter of approximately 3.2 mm.

9. The method of claim 1, wherein the granular drying media has a crush strength that exceeds 25 lbs.

10. The method of claim 1, wherein the granular drying media has a surface area of greater than or equal to 340 $m^2/g$.

11. The method of claim 1, wherein the mineral is a metallic ore.

12. The method of claim 1, wherein the mineral slurry comprises iron ore, salt, bauxite, phosphates, gypsum, alumina, maganese, aluminum, potash, chromium, kaolin, magnetite, feldspar, copper, bentonite, zinc, barytes, titanium, fluorspar, borates, lead, sulphur, perlite, diatomite, graphite, asbestos, nickel, zirconium, or zinc.

13. The method of claim 1, wherein the first volume of mineral slurry has been subjected to a size separation step prior to step (a).

14. The method of claim 1, wherein the first volume of mineral slurry has been subjected to a moisture reduction step prior to step (a).

15. The method of claim 1, wherein the second volume of granular drying media comprises a molecular sieve, a hydratable polymer, a desiccant or a mixture thereof.

16. The method of claim 1, wherein the second volume of granular drying media comprises activated alumina.

17. The method of claim 1, wherein step (c) is conducted using a sieve screen.

18. A method for reducing mineral slurry moisture comprising:

(a) contacting a first volume of mineral slurry with a second volume of granular drying media:

(b) reducing the moisture content of the mineral slurry by transferring moisture from minerals in the mineral slurry to the granular drying media; and (c) separating the granular drying media from the minerals by difference in particle size, wherein the mineral slurry comprises a mineral that does not decompose at thermal drying temperatures, further comprising a step (d) of regenerating the granular drying media after step (c), wherein the step (d) of regenerating the granular drying media utilizes a combination of heat exchange and cross-flow air.

19. The method of claim 18, wherein the second volume of granular drying media comprises activated alumina.

20. The method of claim 18, wherein the mineral slurry comprises iron ore, salt, bauxite, phosphates, gypsum, alumina, maganese, aluminum, potash, chromium, kaolin, magnetite, feldspar, copper, bentonite, zinc, barytes, titanium, fluorspar, borates, lead, sulphur, perlite, diatomite, graphite, asbestos, nickel, zirconium, or zinc.

21. The method of claim 18, wherein the second volume of granular drying media comprises a molecular sieve, a hydratable polymer, a desiccant or a mixture thereof.

22. The method of claim 18, wherein the method is continuous.

* * * * *

UNITED STATES PATENT AND TRADEMARK OFFICE

CERTIFICATE OF CORRECTION

PATENT NO. : 9,004,284 B2
APPLICATION NO. : 13/841191
DATED : April 14, 2015
INVENTOR(S) : Bland et al.

It is certified that error appears in the above-identified patent and that said Letters Patent is hereby corrected as shown below:

Title Page, item (71) Applicant to read:

(71) Applicant: Vitrinite Services, LLC, Midlothian, VA (US)

Signed and Sealed this
Twenty-first Day of July, 2015

Michelle K. Lee

Michelle K. Lee
*Director of the United States Patent and Trademark Office*